US008851142B2

(12) United States Patent
Birkestrand

(10) Patent No.: US 8,851,142 B2
(45) Date of Patent: Oct. 7, 2014

(54) VERTICAL BLIND ASSEMBLY

(76) Inventor: Jason T. Birkestrand, Netwon Center, MA (US)

( * ) Notice: Subject to any disclaimer, the term of this patent is extended or adjusted under 35 U.S.C. 154(b) by 30 days.

(21) Appl. No.: 13/575,083

(22) PCT Filed: Apr. 1, 2011

(86) PCT No.: PCT/US2011/000588

§ 371 (c)(1),
(2), (4) Date: Jul. 25, 2012

(87) PCT Pub. No.: WO2011/129864

PCT Pub. Date: Oct. 20, 2011

(65) Prior Publication Data

US 2013/0068401 A1 Mar. 21, 2013

Related U.S. Application Data

(60) Provisional application No. 61/322,981, filed on Apr. 12, 2010.

(51) Int. Cl.
*E06B 9/32* (2006.01)
*E06B 9/36* (2006.01)
*E06B 9/40* (2006.01)

(52) U.S. Cl.
CPC . *E06B 9/36* (2013.01); *E06B 9/368* (2013.01); *E06B 9/40* (2013.01); *E06B 9/367* (2013.01); *E06B 9/364* (2013.01)
USPC ..... 160/120

(58) Field of Classification Search
CPC ..... E06B 2009/2458; E06B 2009/1746; E06B 9/367; E06B 2009/17038
See application file for complete search history.

(56) References Cited

U.S. PATENT DOCUMENTS

| | | | | | |
|---|---|---|---|---|---|
| 1,557,058 | A | * | 10/1925 | Valdemar | 160/133 |
| 2,100,976 | A | * | 11/1937 | Norton | 160/133 |
| 2,207,720 | A | * | 7/1940 | Cole et al. | 370/214 |
| 2,370,794 | A | * | 3/1945 | Houmere | 160/113 |
| 2,636,556 | A | | 4/1953 | Light et al. | |
| 2,855,241 | A | * | 10/1958 | Walter | 296/97.8 |
| 3,075,805 | A | * | 1/1963 | Golde et al. | 296/98 |
| 4,641,700 | A | * | 2/1987 | Zveibil | 160/133 |
| 5,231,708 | A | * | 8/1993 | Hansen | 4/608 |
| 2013/0068401 | A1 | * | 3/2013 | Birkestrand | 160/133 |

FOREIGN PATENT DOCUMENTS

| | | | |
|---|---|---|---|
| KR | 100 817 245 B1 | | 3/2008 |
| KR | 100817245 | * | 3/2008 |

* cited by examiner

*Primary Examiner* — Blair M Johnson
(74) *Attorney, Agent, or Firm* — Cesari and McKenna, LLP

(57) ABSTRACT

A vertical blind assembly module includes a head rail unit with opposite sides and a unit axis extending between the sides, a housing and an axle pivotally connecting the housing to the head rail unit so that the housing can pivot about a pivot axis that is perpendicular to the unit axis. A slat is coiled in the housing so enabling the slat to be extended from the housing a selected distance and retracted into the housing. A foot rail unit is pivotally connected to the projecting end of the slat, the pivotal connection being collinear to the pivot axis. By turning the axle relative to the head rail unit about the pivot axis when the slat is extended, the slat can be turned between a closed position wherein the slat is parallel to the unit axis and an open position wherein the slat is perpendicular to the unit axis.

21 Claims, 8 Drawing Sheets

VERTICAL BLIND ASSEMBLY

CROSS-REFERENCE TO RELATED APPLICATION

The present application claims the benefit of Provisional Application Ser. No. 61/322,981, filed Apr. 12, 2010, and the PCT Patent Aplication No. PCT/US11/00588, which was filed on Apr. 1, 2011, the contents of which are hereby incorporated by reference herein.

BACKGROUND OF THE INVENTION

This invention relates to blinds. It relates especially to a modular vertical window blind assembly which can be custom fitted to a variety of different window or opening shapes and sizes. We will describe the invention in the context of a window blind. However, it should be understood that the invention is also applicable to a blind for a door having a light and even to a blind or curtain for an opening such as a doorway or passageway to control the amount of hot or cold air entering or leaving a room.

Conventional vertical window blinds have vertical slats on louvers suspended from a head rail that can be mounted at the top of a window so that the slats extend down to the bottom of the window. By turning a wand, the slats can be rotated in unison about their vertical axes between a closed position wherein the slats lie almost parallel to the window essentially forming a single panel which blocks the light and an open position wherein the slats are oriented at right angles to the window, thus allowing a maximum amount of light to pass through the blind. The slats can also be set at any angle between those two extremes. However, even when slats of the prior blinds are in their fully open position, they still occlude the window to some extent in that an observer sees the edges of the slats when looking out the window.

Some vertical blinds are also disadvantaged in that they are usually fabricated in relatively few widths to fit standard window sizes. Therefore, they may not be suitable for windows that do not conform to those standards.

SUMMARY OF THE INVENTION

Accordingly, the present invention aims to provide an improved vertical blind assembly which is of a modular construction so that it can be made to fit substantially any size window.

Another object of the invention is to provide an assembly of this type whose vertical slats can be raised and lowered in unison like a window shade.

A further object of the invention is to provide such an assembly whose vertical slats can be rotated about their vertical axes, even when the slats are partially raised.

Another object of the invention is to provide a vertical window blind assembly whose slats are easily replaceable when damaged or for decorative reasons.

Still another object of the invention is to provide a window blind assembly which is devoid of the unsightly cords and travelling slat supports required in conventional horizontally drawn blinds.

An additional object of the invention is to provide a window blind assembly which is easy to put up and take down, making it especially suitable for renters.

Other objects will, in part, be obvious and will, in part, appear hereinafter. The invention accordingly comprises the features of construction, combination of elements and arrangement of parts which will be exemplified in the following detailed description and the scope of the invention will be indicated in the claims.

In general, my vertical blind assembly has a head rail for mounting horizontally in an opening and a vertically extensible blind, including slats and a foot rail, suspended from the head rail. The head rail and blind are composed of a sufficient number of similar modules connected together side by side to span the opening. Each module includes a head rail unit coupled to at least one adjacent head rail unit, a housing pivotally connected by an axle to the associated head rail unit, an elongated flexible slat coiled in the associated housing with an end of the slat projecting from the housing enabling the slat to be extended from and retracted back into the housing, and a foot rail unit connected to at least one adjacent foot rail unit and being pivotally secured along its width to the projecting end of the associated slat. The pivot axis of the foot rail unit is collinear to the axle so that when the blind is extended to position the foot rail at any selected distance from the head rail, the slats of all of the modules may be turned between closed positions wherein the slats are parallel to the head and foot rails and block the openings and open positions wherein the slats are perpendicular to the head and foot rails and expose the opening. A turning mechanism in the head rail of each module connects to similar turning mechanisms in the other module(s) to turn the slats of all the modules in unison between their respective open and closed positions.

Thus, by employing an appropriate number of modules, the assembly can be fitted to a window of practically any width. Even bow or bay windows may be accommodated by employing flexible couplings between the adjacent modules as will be described in detail later.

As will also be seen, the modules are easy to assemble and the assembly as a whole is easy to install in a window or other opening. Therefore, the assembly should find wide application, particularly in the apartment rental market.

BRIEF DESCRIPTION OF THE DRAWINGS

For a fuller understanding of the nature and objects of the invention, reference should be made to the following detailed description taken in connection with the accompanying drawings, in which.

DESCRIPTION OF THE PREFERRED EMBODIMENTS

Figure 1A:
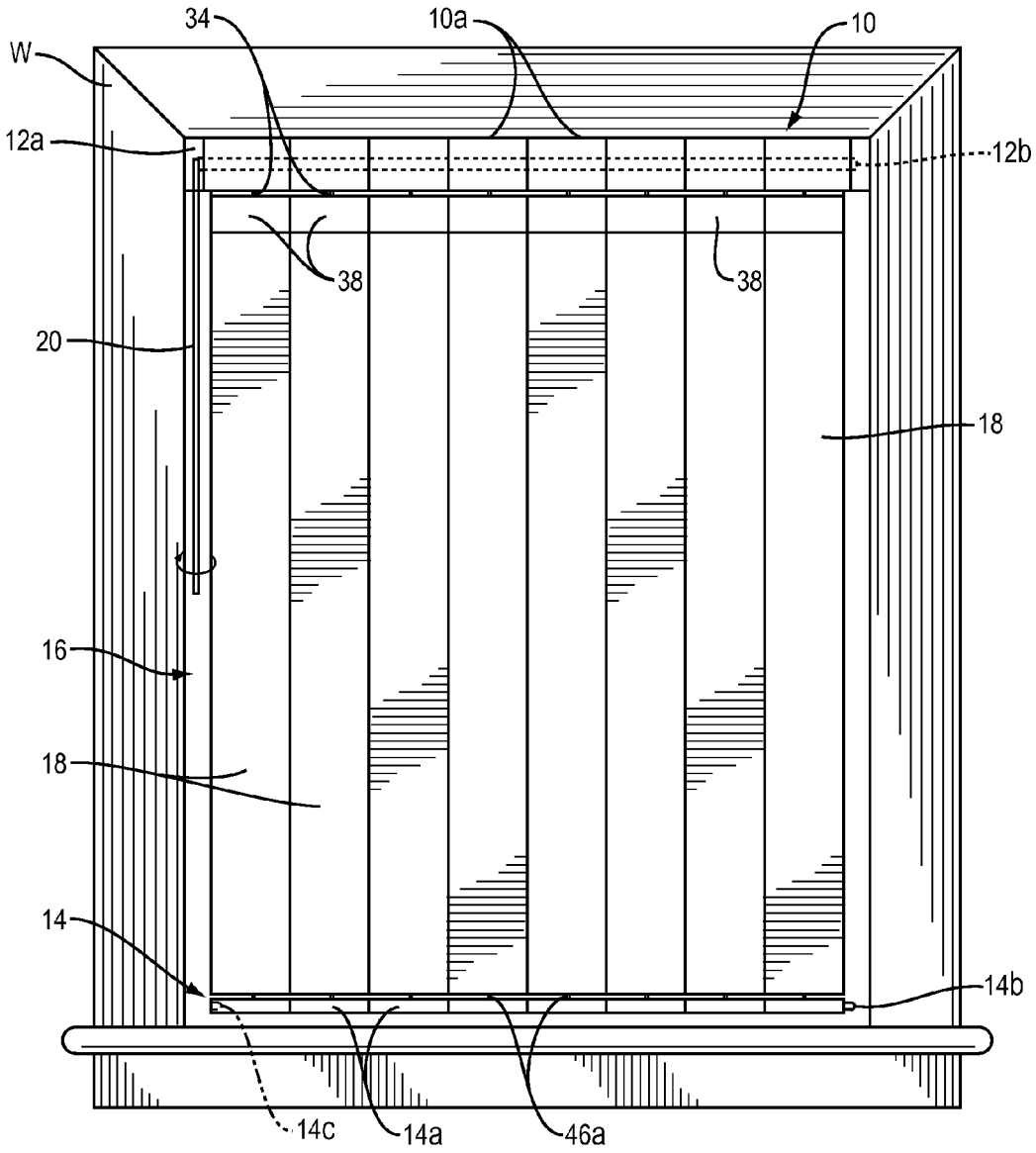
FIG. 1A is a front elevational view of my modular window blind assembly whose blind, composed of a plurality of modules, is in a fully extended or lowered position in a window and with the slats of the blind shown in their fully closed positions thus preventing light from passing through the blind.
Figure 1B:
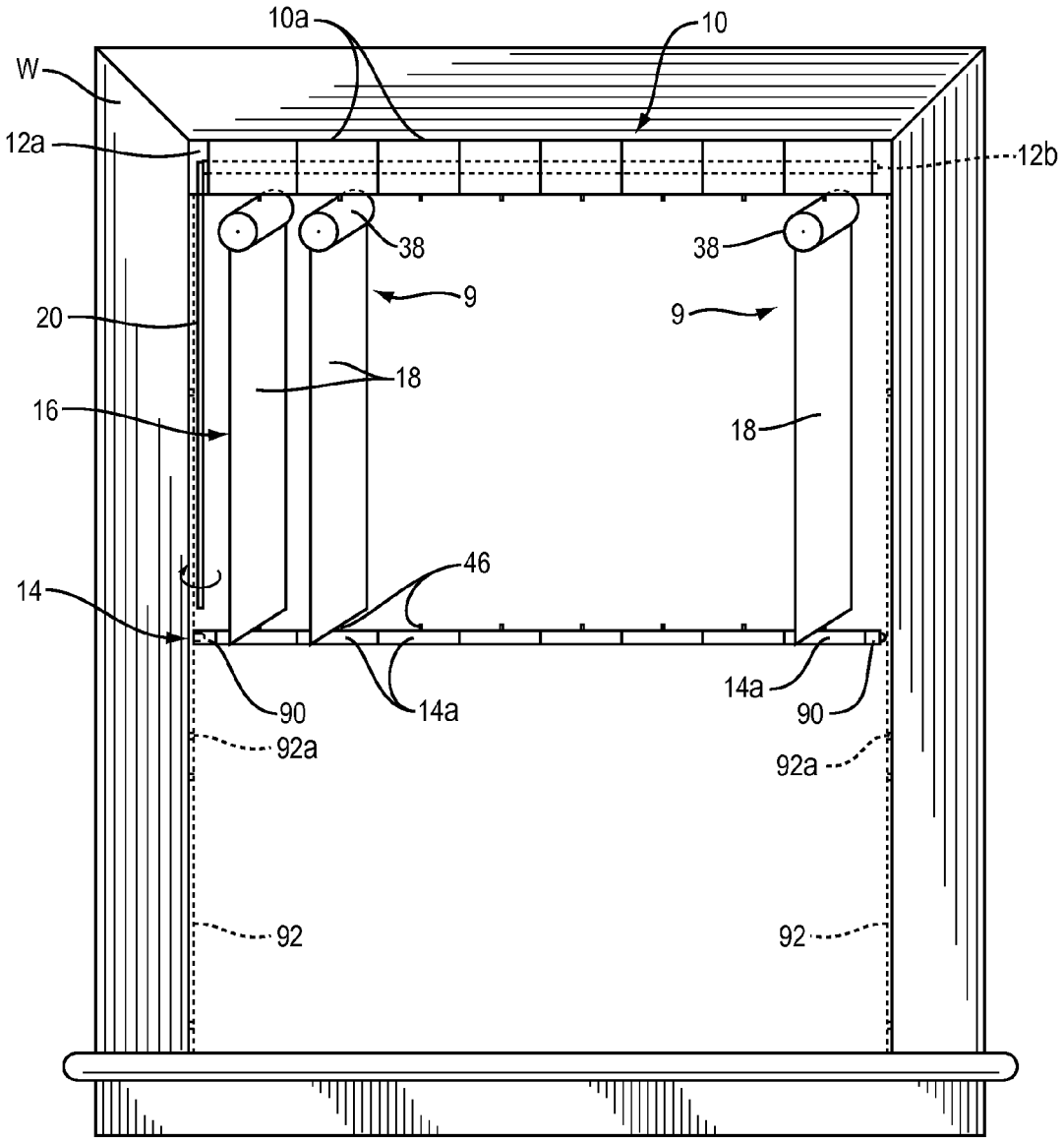
FIG. 1B is a similar view of the assembly showing the blind in a partially raised position with the slats partially open so that a desired amount of light can pass through the blind.

As shown in FIGS. 1A and 1B, my vertical blind assembly comprises a head rail 10 mounted at the top of a window W by means of brackets 12*a* and 12*b* which support the opposite ends of the head rail. The assembly also includes a foot rail shown generally at 14, and extending between the head rail and the foot rail is a window blind 16 comprised of a plurality of vertical slats or louvers 18. By pulling down or lifting up the foot rail 14, the blind 16 may be moved from a fully extended or lowered position shown in FIG. 1A to a partially retracted or raised position shown in FIG. 1B and then to a fully raised or retracted position, not shown, wherein the foot rail 14 lies just under the head rail 10 so that the blind 16 does not obstruct the view through the window. Furthermore, by turning a wand 20 in one direction or the other, the slats 18 of blind 16 can be rotated about their vertical axes from a fully closed position as shown in FIG. 1A wherein the slats lie parallel to the head and foot rails and the window forming a panel that covers the window, through a partially open position shown in FIG. 1B so that a selected amount of light can pass through the blind to a fully open position wherein the slats 18 are perpendicular to the head and foot rails and window so that light can pass through the extended length of blind 16.

Thus, my window blind assembly is quite versatile in that when blind 16 is in its fully raised position, there is substantially no visual obstruction of the window W. Also, when the blind is in a partially raised position as shown in FIG. 1B, the slats 18 can still be oriented so that they prevent direct sunlight from entering the room through the upper portion of the window, yet an observer can look through the lower area of the window without having to see slat edges, as is the case with conventional vertical window blind assemblies. For especially tall windows, it is even possible to mount two of the illustrated assemblies in the same window, one at the top and the other, say, halfway down the window so that the amount of light entering through the upper and lower halves of the window can be controlled separately.

Figure 2A:
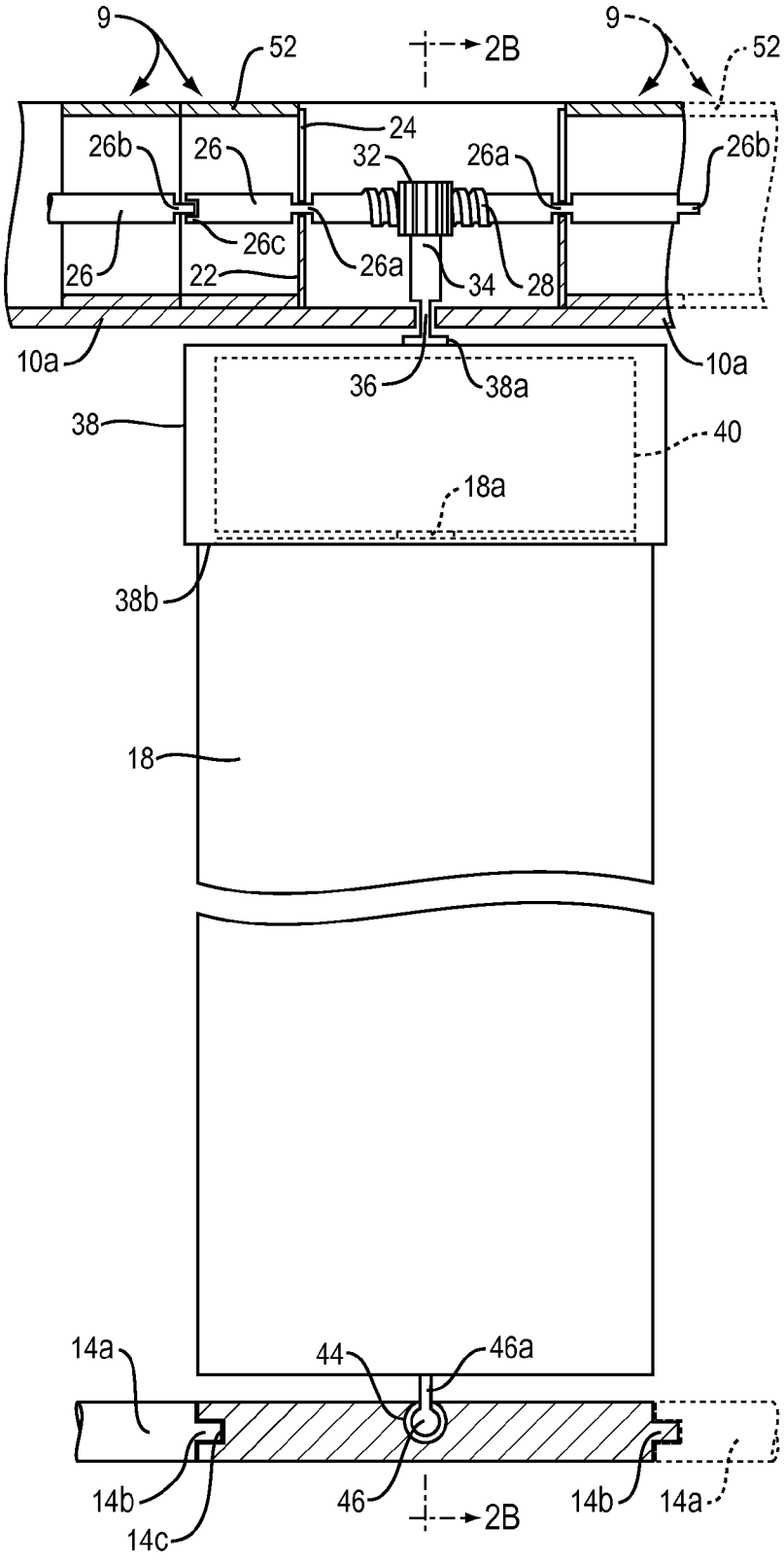
FIG. 2A is a front elevational view with parts broken away, on a larger scale, showing a module of the FIG. 1 assembly in greater detail.
Figure 2B:
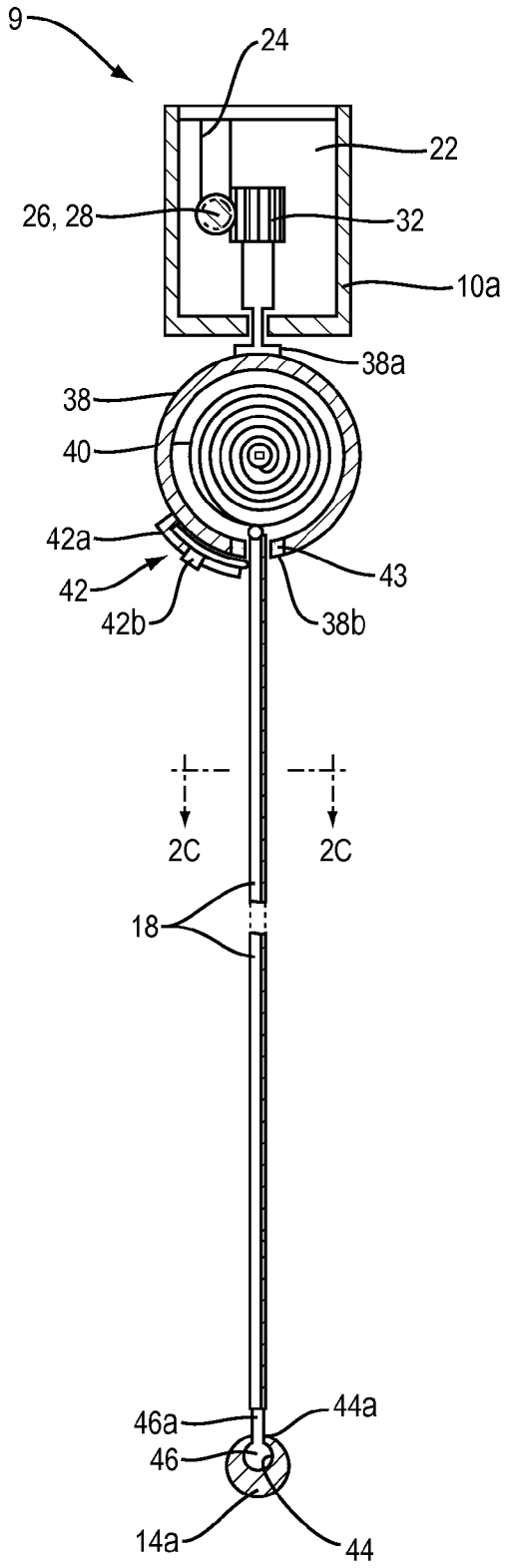
FIG. 2B is a sectional view taken along line 2B-2B of FIG. 2A.

Referring now to FIGS. 1A, 2A and 2B, the blind assembly is actually composed of a plurality of substantially identical modules 9, one for each slat 18. Each module includes a head rail or segment 10*a* which can be connected end to end to the units or segments 10*a* of adjacent modules 9 to form a head rail 10 that is long enough to span the window opening. Each unit 10*a* has a generally U-shaped cross-section and is provided with a pair of interior partitions 22 spaced apart along its length, each partition being formed with a vertical slot 24. The two slots 24 are aligned and adapted to receive a shaft segment 26 whose length is more or less the same as that of unit 10*a*. The shaft segment is necked down at 26*a* where it contacts the edges of the slots so that when the shaft 26 bottoms in the slots, it is captured axially by the slot walls, yet is free to rotate about its axis. One end of shaft segment 26 is formed with a key 26*b*, and a keyway 26*c* is present at the other end of the shaft segment. Also, a worm gear 28 is located midway along the segment.

Worm gear 28 meshes with a gear 32 at the upper end of an axle 34 forming a motion converter. The axle is rotatably mounted at 36 to the bottom wall of unit 10*a* so that axle 34 is fixed in the axial direction but free to rotate. Mounted to the lower end of axle 34 is a cylindrical housing 38 which contains a spring mechanism 40 similar to the one present in a conventional tape measure. Preferably, the housing 38 is releasably secured to the lower end of axle 34 so that it can be removed and replaced easily. For example, the lower end of axle 34 may have a non-circular cross section and plug into a similarly shaped socket 38*a* at the top of the housing. A spring-loaded ball 41 (FIGS. 4A and 4B) present near the end of axle 34 releasably engages in a groove to retain the shaft end in the socket.

Figure 2C:
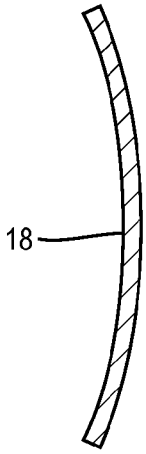
FIG. 2C is a sectional view on a still larger scale taken along line 2C-2C of FIG. 2B.

The upper end of the corresponding slat 18 is releasably connected at 18*a* to that mechanism 40 so that the slat can be wound up into a coil inside the housing. Slat 18 is similar to the tape in a conventional tape measure except that it is wider. That is, the slat is made of a springy metal or plastic material and has a camber as shown in FIG. 2C so that the slat may be rolled up in, and dispensed from, the housing 38 via a slot 38*b* therein located opposite axle 34, yet the slat is relatively stiff when extended much like the metal tape of a tape measure. In other words, when each slat 18 is pulled down via foot rail 14, it is drawn from the associated housing 38 in opposition to the bias of spring mechanism 40 therein and when the slat is pushed up, it is automatically wound up inside the housing by that mechanism.

A manually adjustable brake shown generally at 42 may be mounted to the outside of housing 38 adjacent to slot 38*b*. As best seen in FIG. 2B, the brake includes a slide 42*a* integral to the outside of the housing and a slider 42*b* movable along the slide. When the slider 42*b* is slid toward slot 38*b*, an end thereof frictionally engages the face of slat 18. The slider can be adjusted so that it exerts just the right amount of drag on slat 18 so that the slat will remain at the elevation to which it is set by the user.

Also, if desired, the edges of the housing slot 38*b* may be lined with a flock or brush material 43 so that the slat 18 is automatically dusted when moved in and out of the housing 38.

Each module 9 of the assembly also includes a foot rail unit 14*a* in the form of a generally cylindrical rod which may be connected end to end to the foot rail units 14*a* of adjacent modules to form the complete foot rail 14 shown in FIGS. 1A and 1B. To achieve this objective, one end of each unit 14*a* has a key 14*b* and the other end is formed with a keyway 14*c*. Each unit 14*a* also has a keyhole-type socket 44 midway along its length. The socket is shaped and adapted to accept a ball 46 affixed via a stem 46*a* to the lower end of the associated slat 18 so that once the ball is inserted into the socket via a socket mouth 44*a* (FIG. 2B), it is locked therein but still free to rotate about a vertical axis that is collinear to the axle 34 of that module 9.

As noted above, each module 9 may be joined to adjacent similar modules. More particularly, as shown in FIG. 2A, each head rail unit 10*a* may be connected to an adjacent head rail unit by a tubular coupling 52 which slides into the ends of the abutting units 10*a*, until it is stopped by partitions 22. When this connection is made, the key 26*b* of the shaft segment 26 in one unit 10*a* may be inserted into the keyway 26*c* of the shaft segment 26 of the adjacent unit 10*a*. In addition, the foot rail units 14*a* of the adjacent modules 9 being joined together may be linked by inserting the key 14*b* of one unit or segment 14*a* into the keyway 14*c* of the abutting unit 14*a*. Preferably, the keys 14*b* and keyways 14*c* are designed so that when the units 14*a* are keyed together, all of the sockets 44 face upwards as shown in FIGS. 1A and 2A.

Thus, when all of the modules 9 are joined together, head rail units 10*a* collectively form a common, straight rigid head rail 10 and the foot rail units 14*a* collectively form a common, straight foot rail 14. Also, the shaft segments 26 of all the modules 9 are keyed together end to end to form a common shaft which may be rotated from one end. As best seen in FIG. 2A, when the shaft segments 26 are rotated in one direction or the other, their worm gears 28 turn the corresponding gears 32 which, via axles 32, rotate housings 38 and the slats 18 extending therefrom in unison about the longitudinal axes of the slats. The slats are free to rotate relative to the straight foot rail 14 by virtue of the ball and socket connections between the individual slats and their associated foot rail units or segments 14*a*. In this way, the slats can be turned in unison between their respective open and closed positions.

In the window blind assembly depicted in FIGS. 1A and 1B, the housings 38, slats 18 and foot rail segments 14*a* have the same width as head rail segments 10*a*. Resultantly, when the blind 16 is in its closed condition shown in FIG. 1A, the slats 18 are arranged edge to edge. In some applications, the blind may be designed so that when it is closed, the adjacent slats 18 overlap to some extent. For this, the housings 38, slats 18 and foot rail units 14*a* are made, say, 10% wider than the head rail units 10*a* so that when the blind 16 is fully closed, the overlapping housings 38, slats 18 and foot rail units 14*a* are oriented at a small angle, e.g., 10-15°, which assures that there will be no gaps between the slats when blind 16 is closed.

Figure 3:
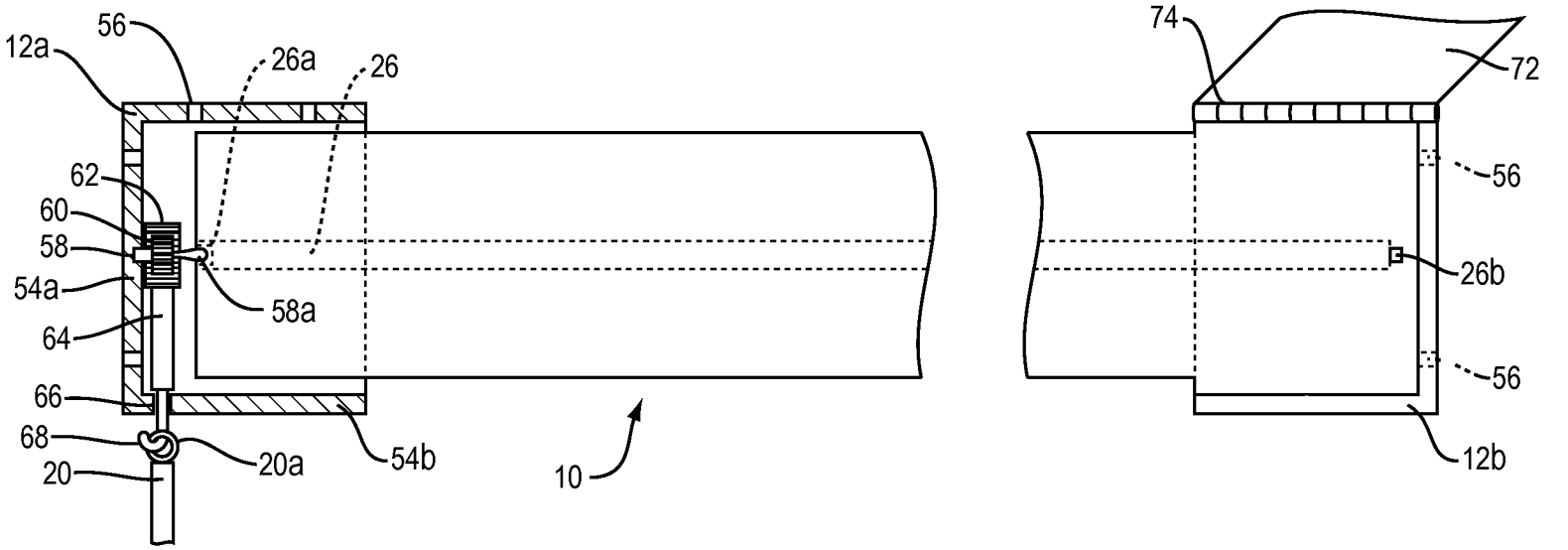
FIG. 3 is a longitudinal sectional view, with parts broken away, showing the ends of the FIGS. 1A and 1B assembly in greater detail.

Turning now to FIG. 3, as noted above, the head rail 10 is supported by brackets 12*a* and 12*b*. Bracket 12*a* is formed as a rectangular cap lying on its side. That is, it has an end wall 54*a* and fastener holes 56 for mounting the bracket to the casing of window W (FIG. 1A). Rotatably mounted to that wall is one end of an axle 58 whose other end is formed as a key 58*a* which keys into the keyway 26*c* of the shaft 26 at the left end of head rail unit 10 when that end is inserted into bracket 12*a*. Axle 58 carries a gear 60 which meshes with a worm gear 62 at the upper end of a shaft 64 rotatably mounted at 66 in the lower wall 54*b* of bracket 12*a*. The lower end of shaft 64 extending down from the bracket terminates in a hook 68 which hooks through an eye 20*a* at the upper end of wand 20. Thus, when the wand 20 is rotated about its axis, that motion is transmitted to the worm gear 62 which, in turn, rotates all of the shaft segments 26 and thus all of the gears 32 and slats 18 in unison.

The other bracket 12*b* supporting the right end of head rail 10 has a configuration similar to that of bracket 12*a* except that it has a front wall or corner 72 that is hinged at 74 to the top wall of the bracket so that the cover can be swung up to allow the right end of head rail 10 to be inserted into bracket 12*b* after the left end of the head rail has been plugged into bracket 12*a* as just described. After the right end of the rail 10 is seated in bracket 12*b*, the cover 72 may be swung down to close the front of the bracket. The lower end of the cover 72 may be formed with a lip (not shown) which underhangs the lower wall of bracket 12*b* to retain the corner in its closed position.

It will be appreciated from the foregoing that the modular construction of my assembly enables modules 9 to be joined so that the blind assembly as a whole can be made to fit a window of almost any width. Also, if one or another of the slats 18 should become damaged, it is easily replaced by disconnecting its upper end connection 18*a* at the associated housing 38 and disconnecting its ball 46 from the associated foot rail unit 14*a*. Alternatively, the housing may be separated at its socket 38*a* from the associated axle 34 and the associated foot rail segment 14*a* detached from its neighboring segments 14*a*. In a similar fashion, the slats 18 may be changed easily to suit a particular user's decorative intent.

It is apparent from the foregoing that the various modules 9 are easy to assemble and the overall assembly is easy to install in, and take down from, a window so that the blind assembly is particularly useful to people who move frequently or who rent apartments. When the assembly is in place, its blind 16 can be raised and lowered easily by lifting up and pulling down the foot rail 14 and even when the blind 16 is in a partially raised or extended position, the slats 18 still can be oriented to allow the desired amount of light to pass through the blind.

Figure 4B:
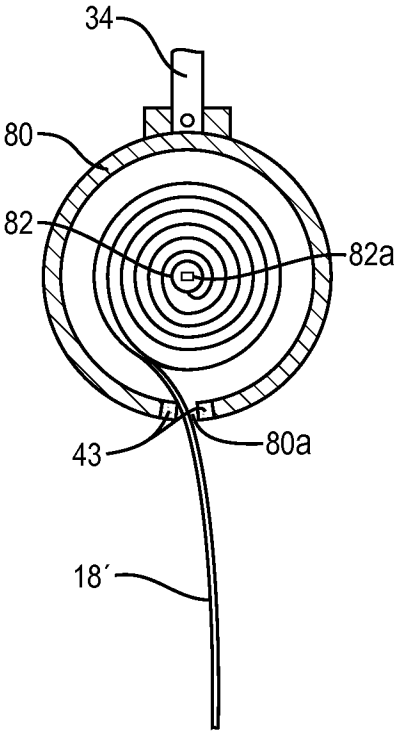
FIG. 4B is a sectional view taken along line 4B-4B of FIG. 4A.
Figure 4A:
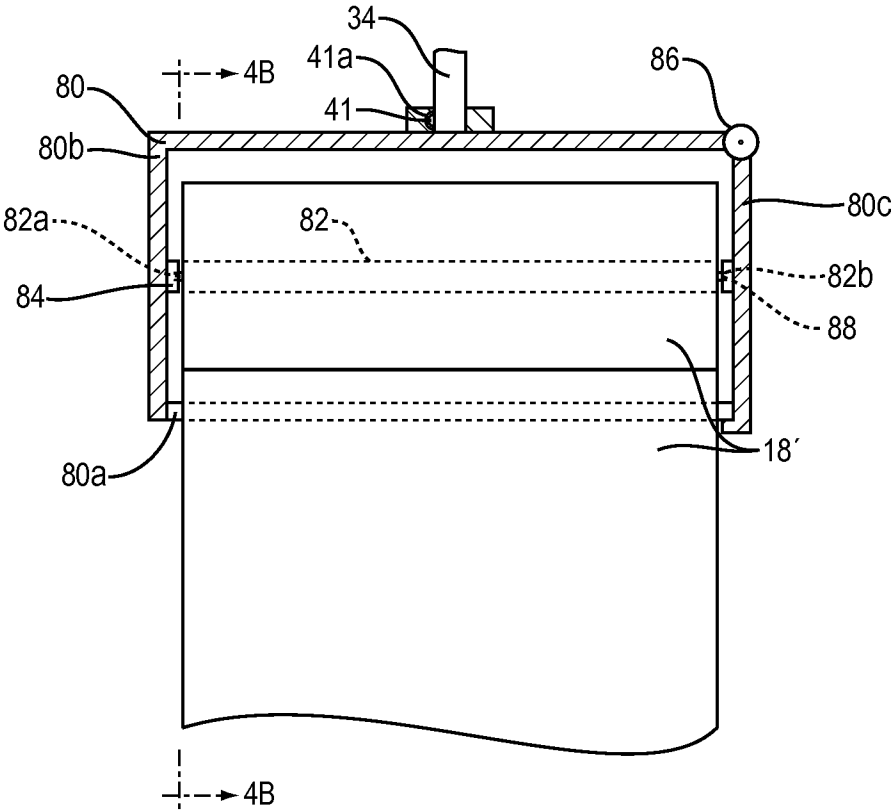
FIG. 4A is a front elevational view, with parts in section, of an alternative module embodiment for use in the FIGS. 1A and 1B assembly.

Referring now to FIGS. 4A and 4B, in some applications it may be desirable for the blind 16 (FIG. 1A) to comprise slats 18' of a non-springy fabric or plastic material. Such a slat may be dispensed through a slot 80*a* of a cylindrical housing 80 comparable to housing 38 in FIGS. 2A and 2B. In this case, however, housing 80 contains a roller 82 around which the slat 18' may be wound. Roller 82 is similar to a conventional window shade roller except that it is quite short commensurate with the narrow width of the slat 18'. The roller 82 does contain the usual spring and ratchet found in a standard window shade roller so that the slat 18' can be drawn from, and rolled up on, the roller.

Housing 80 has an end wall 80*b* formed with a rectangular hole 84 for receiving the usual flat end of the ratchet axle 82*a* projecting from one end of roller 82. The other end wall 80*c* of housing 80 is hinged at 86 to the top of the housing so that it can be opened, enabling roller 82 to be inserted into the housing. The wall 80*c* is formed with a round hole 88 so that when the door is closed, hole 88 receives the round axle 82*b* that projects from the adjacent end of roller 82. Thus, when the wall 80*c* is closed, roller 82 is rotatably supported within the housing 80 and when it is rotated to dispense slat 18', the roller spring is wound up so that there is a upward bias on the slat 18'. However, upward movement of the slat is prevented by the ratchet in the roller unless the ratchet is released by pulling down, and then releasing, the slat as is done with the panel of a conventional window shade. The ratchets in the rollers 82 of all modules comprising the assembly should be aligned initially so that they all operate substantially in unison when blind 16 is raised and lowered. A window blind 16 incorporating the flexible slats 18' can be adjusted to open and close the slats even when the blind is in a partially raised position in the same manner described above in connection with the assembly depicted in FIGS. 1A and 1B.

In some instances, it may be desirable to positively secure the foot rail 14 when the shade 16 is at a desired elevation in window W particularly when the blind comprises fabric slats 18'. For this, one or more foot rail extensions 90 may be added to the opposite ends of the foot rail 14 as shown in FIG. 1B to extend the foot rail to the sides of the window casement. Also, a vertical strip 92 formed with a series of spaced apart keys or keyways 92*a* may be adhered or otherwise secured to the interior side walls of the window casement as shown in phantom in FIG. 1B. In FIG. 1B, the right hand strip 92 carries keyways to receive the key 14*b* at the extended right end of the foot rail 14 and the strip 92 at the left side of that figure has keys which can project into the keyway 14*c* at the extended left end of the foot rail 14. In this way, the blind 16 can be secured at a variety of different elevations in the window W. Of course, when the shades are secured in this fashion, the brake and ratchet mechanisms in the housings 38 and 80 for controlling the vertical movement of the slats would not be required.

Figure 5:
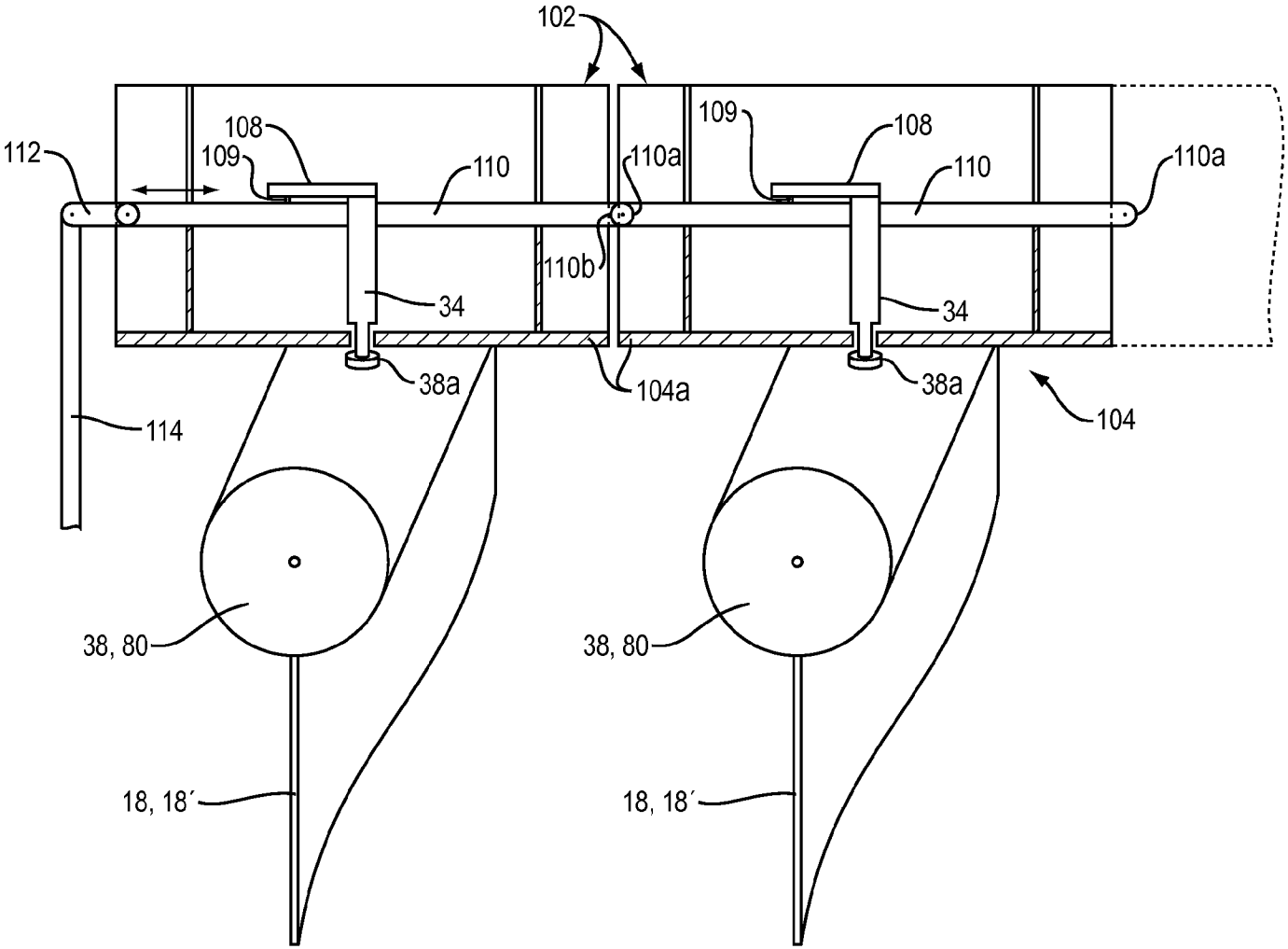
FIG. 5 is an isometric view with parts cut away showing still another module embodiment for use in the FIGS. 1A and 1B assembly.

Refer now to FIG. 5 illustrating another embodiment of my window blind assembly which includes a somewhat different mechanism for rotating the slats 18 or 18'. This embodiment is comprised of identical modules shown generally at 102, each of which includes a channel-shaped head rail unit or segment 104*a* similar to unit 10*a* described above. The couplings 52 for joining adjacent units to form a complete head rail 104 have been omitted for ease of illustration. As before, each module 102 also includes a slat housing 38 or 80 pivotally connected by an axle 34 to the bottom wall of each unit 104*a* midway along its length. However, instead of providing a worm gear at the upper end of axle 34 to form the motion converter, that axle is topped off by a short lever arm 108 which extends laterally within the head rail unit or segment 104*a*. The free end of the lever arm 108 is pivotally connected at 109 to an actuator unit or segment 110 which extends along the length of that unit 104*a* and is slidably supported by slotted partitions 111. Each actuator unit 110 is formed with a hook 110*a* at one end and an eye 110*b* at its opposite end, the hook and eye being adapted to mate with the eye and hook, respectively, of adjacent actuator units 110. When the actuator units or segments 110 are secured together and moved one way or the other along the head rail 104, the slats 18 or 18' are rotated in unison between their open and closed positions as described above.

To facilitate moving the actuator units, an actuator extension 112 may be connected to the actuator unit at an end of the head rail 104, e.g. the left end as shown in FIG. 5. The other end of the extension 112 connects to a vertical wand 114 by which a user may open and close the slats 18 or 18', even when the slats are partially raised. Thus, the FIG. 5 embodiment has all of the advantages described above in connection with the blinds depicted in the other drawing figures. It has an additional advantage in that it is less expensive to make than those other embodiments because it requires no gears.

Figure 6:
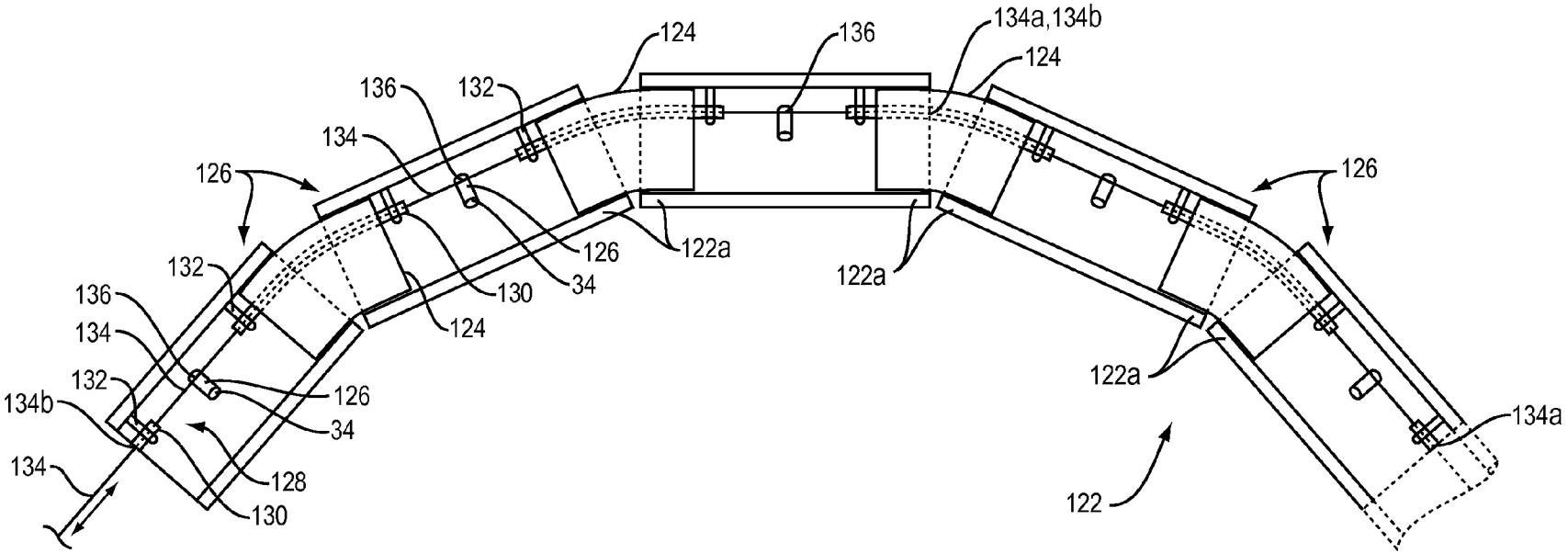
FIG. 6 is a top plan view of a modular blind assembly embodiment suitable for a bow window.

Refer now to FIG. 6, which illustrates an embodiment of my window blind assembly which may be fitted to a bow window having substantially any curvature. This embodiment comprises a plurality of similar modules indicated at 120, each of which includes a channel-shaped head rail unit or segment 122*a*. The units 122*a* of adjacent modules may be secured together by flexible couplings 124 to form a complete head rail 122. A slat housing 38 or 80 (not shown) is suspended from each head rail unit by an axle 34, which in this case is topped off by a lever arm 126.

Positioned inside each head rail unit 122*a* is a segment 128 of coaxial cable similar to a speedometer cable. That is, cable segment 128 has a flexible outer sheath 130 which is secured at two points 132 along the sheath to the associated unit 122*a* and a flexible inner wire 134 which is movable relative to sheath 130, both rotationally and longitudinally. The sheath 130 is cut away between points 132 to allow a connection at 136 of the cable wire 134 to the free end of the lever arm 126 in that unit or segment 122*a*. Preferably, each connection 136 is adjustable, e.g. a sleeve at the end of the lever arm with a set screw, so that the connections 136 can be adjusted along the wires 134. In this way, the open and closed positions of all of the slats in the blind can be set, depending on the curvature of the bow window, so that all the slats open and close together.

Still referring to FIG. 6, the wire component 134 of the cable segment 128 in each head rail unit or segment 122*a* is formed with a hook 134*a* at one end and an eye 134*b* at the other end, enabling those wires to be hooked to the eyes and hooks, respectively, of the wires 134 in the adjacent head rail units 122*a* comprising the head rail 122. A wire extension 138 may be hooked to the wire 134 at one end of the head rail, e.g. the left end shown in FIG. 6, that extension leading to a wand (not shown), enabling a user to move all of the wires 134 in one direction or the other to rotate all of the housings 38 or 80 in unison to open and close the slats 18 or 18', as described above. Due to the presence of the bow, the edges of adjacent slots may be spaced apart to some extent. However, the blind will still block most of the sunlight incident on the blind. To avoid such gaps, the slats can be designed to overlap as described above.

Of course, if each wire 134 were fitted with a worm gear along its length for meshing with a gear mounted to the top of axle 34 of the associated module 120, the common wire could be rotated to turn the slats 18 or 18' in the same manner described above in connection with FIGS. 2A and 2B.

Figure 6B:
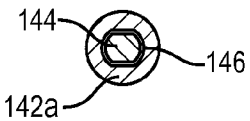
FIG. 6B is a sectional view taken along line 6B-6B of FIG. 6A.
Figure 6A:
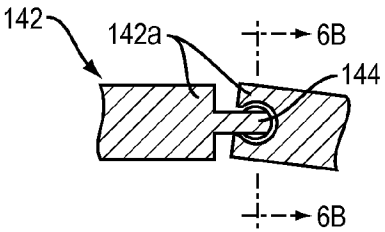
FIG. 6A is a fragmentary longitudinal sectional view showing a segment of a curved foot rail for use in the FIG. 6 embodiment.

Since the blind assembly shown in FIG. 6 has a curved head rail, it should also have a curved foot rail as shown generally at 142 in FIG. 6A. Rail 142 is composed of straight foot rail units or segments 142*a* which are similar to unit 14*a* depicted in FIG. 2A except that the key and keyways at the ends of the unit are replaced by a ball 144 and socket 146, both of which have flats at their tops and bottoms as shown in FIGS. 6A and 6B so that the adjacent keyed-together units 142*a* can pivot in a horizontal direction but not in a vertical direction.

It should be apparent from the foregoing that all of my vertical blind assembly embodiments have great versatility and can be adapted to many window configurations. The various modules comprising the blind assembly can be made and sold separately and connected together to fit most window dimensions and shapes. Also, since the assembly can be sold in a knock down condition, it can be packaged and stored in a minimum amount of space for easy shipment. Moreover, it is easy to install by the average homeowner without requiring any special tools.

It will thus be seen that the objects set forth above among those made apparent from the preceding description are efficiently attained. Also, since certain changes may be made to the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

The invention claimed is:

1. A vertical blind assembly comprising a module including:

a head rail unit having opposite sides and a unit axis extending between the sides;

a housing;

an axle pivotally connecting the housing to the head rail unit so that the housing can pivot about a pivot axis that is perpendicular to the unit axis;

an elongated flexible slat having a first end and a second end and being coiled in the housing so that the second end projects from the housing through an opening therein enabling the slat to be extended from the housing a selected distance to an extended position and retracted back into the housing to a retracted position; and a shaft unit rotatably mounted to the head rail unit parallel to the unit axis;

a foot rail unit having opposite sides and a pivotal connection to the second end of the slat, the pivotal connection being collinear to the pivot axis, and a turning mechanism in the head rail unit for turning the axle about the pivot axis so that when the slat is extended the selected distance, the slat can be turned between a closed position wherein the slat is substantially parallel to the head rail unit and the foot rail unit and an open position wherein the slat is substantially perpendicular to the the head rail unit and the foot rail unit, wherein the housing, the slat and the foot rail unit have a similar width to that of the head rail unit, and the head rail unit and the shaft are configured to be attached to the head rail unit and the shaft of an adjacent module.

2. The assembly defined in claim 1 and further including a spring mechanism in the housing, the spring mechanism being connected to the first end of the slat to bias the slat to the retracted position.

3. The assembly defined in claim 1 wherein the slat has a camber.

4. The assembly defined in claim 1 and further including a releasable connection between the housing and the axle.

5. The assembly defined in claim 1 and further including one or more cleaning surfaces bounding the opening and which engage the slat as the slat is moved between the extended position and retracted positions.

6. The assembly defined in claim 1 and further including a brake mounted to the housing adjacent to the opening, the brake being operable to stop the slat at any position between the extended position and the retracted position.

7. The assembly defined in claim 1 wherein the opposite sides of the foot rail unit are formed with different first and second connectors.

8. The assembly defined in claim 1 wherein the head rail unit, the housing, the slat, and the foot rail unit have substantially the same width.

9. The assembly defined in claim 1 wherein the turning mechanism comprises:

a shaft unit rotatably mounted to the head rail unit parallel to the unit axis, and a motion converter for converting rotary or linear motion of the shaft unit to rotary motion of the axle.

10. The assembly defined in claim 1 and further including a spring mechanism in the housing connected to the first end of the slat for coiling up and retracting the slat into the housing, thereby coiling up the slat in the housing.

11. The assembly defined in claim 10 wherein the spring mechanism is a spring/ratchet type mechanism associated with a window shade.

12. The assembly defined in claim 10 wherein the spring mechanism is a wind up spring type associated with of a conventional metal tape measure.

13. A vertical blind assembly comprising a module including:

a head rail unit having opposite sides and a unit axis extending between the sides;

a housing;

an axle pivotally connecting the housing to the head rail unit so that the housing can pivot about a pivot axis that is perpendicular to the unit axis;

an elongated flexible slat having a first end and a second end and being coiled in the housing so that the second end projects from the housing through an opening therein enabling the slat to be extended from the housing a selected distance and retracted back into the housing; and a foot rail unit having opposite sides and a pivotal connection to the second end of the slat, the pivotal connection being collinear to the pivot axis, and a turning mechanism in the head rail unit for turning the axle about the pivot axis so that when the slat is extended the selected distance, the slat can be turned between a closed position wherein the slat is substantially parallel to the head rail unit and the foot rail unit and an open position wherein the slat is substantially perpendicular to the head rail unit and foot rail unit, where at least one adjacent additional module being positioned adjacent to the module;

a shaft unit rotatably mounted to the head rail unit parallel to the unit axis;

a motion converter for converting rotary or linear motion of the shaft unit to rotary motion of the axle;

coupling devices coupling together the head rail unit of the module with the head rail unit of an adjacent additional modules to form a single head rail;

connectors connecting together the shaft unit of the module with the shaft unit of the adjacent additional module to form a single shaft;

means for connecting together a first side and a second side of the foot rail unit of the module with the adjacent additional module to form a single foot rail; and an actuating device connected to the shaft unit, in one of the modules of the module and the adjacent additional module, for moving that shaft unit therein rotationally or axially whereby the slats in the module and the adjacent additional module are turned in unison between their respective open and closed positions.

14. The assembly defined in claim 13 wherein the coupling devices are rigid so that the head rail units of the modules collectively form a rigid linear head rail, and the means for connecting the foot rail units of the adjacent modules form rigid connections so that the foot rail units collectively form a substantially rigid linear foot rail.

15. The assembly defined in claim 13 wherein the couplings are flexible so that the head rail units of said modules collectively form a single head rail which may be bowed to a selected curvature, and the means for connecting the foot rail units of the adjacent modules are flexible connections so that the foot rail units collectively form a single foot rail which may be bowed to said selected curvature.

16. The assembly defined in claim 13 wherein the housings, the slats, and the foot rail units of the modules are wider than the head rail units thereof so that when the slats of the modules are extended from their respective housings and turned to their respective closed positions, the slats of adjacent modules overlap.

17. A vertical blind assembly comprising a head rail for mounting horizontally in an opening;

a vertically extendable blind suspended from the head rail and a foot rail, the head rail, the blind, and the foot rail being composed of a sufficient number of similar modules connected together side by side to span the opening, wherein each module includes:

a head rail unit coupled to the head rail unit of at least one adjacent module, a housing pivotally suspended by an axle to an associated head rail unit, an elongated flexible slat having first and second ends and being coiled in the associated housing with the second end of the elongated flexible slat projecting through an opening in the housing enabling the slat to be extended from and retracted back into the housing, a foot rail unit connected to the foot rail unit of the at least one adjacent module and being pivotally secured along its width to the second end of an associated elongated flexible slat, the pivot axis of each foot rail unit being collinear to the associated axle whereby when the blind is extended to position the foot rail at any selected distance from the head rail, a plurality of elongated flexible slats of all of the modules may be turned between respective closed positions wherein the plurality of elongated flexible slats are parallel to the head rail and foot rail and block the opening and respective open positions wherein the plurality of elongated flexible slats are perpendicular to the head rail and the foot rail and expose the opening, and a turning mechanism in the head rail unit to turn the plurality of elongated flexible slats of all of the modules in unison between their respective open and closed positions, the head rail units of adjacent modules are flexibly coupled together so that the head rail as a whole may be bowed, and wherein the foot rail units of an adjacent modules are flexibly connected together so that the foot rail as a whole may be bowed to the same extent as the head rail.

18. The assembly defined in claim 17 wherein each module also includes a mechanism in the associated housing to releasably set the extension of the slat extending from that housing so that the blind as a whole may be extended to position the foot rail a selected distance from the head rail.

19. The assembly defined in claim 17 wherein the slats, the housings, and the foot rail units are wider than the associated head rail units so that the plurality of elongated flexible slats of adjacent modules overlap when the blind is extended and the plurality of elongated flexible slats are turned to their respective closed positions.

20. A vertical blind assembly comprising a head rail for mounting horizontally in an opening, the head rail having a plurality of head rail units each having opposite sides and a unit axis extending between the sides:

a shaft unit rotatably mounted to each head rail unit parallel to the unit axis;

a plurality of vertically extendable blinds each having an upper end suspended from the head rail unit and a lower end, and a foot rail having a plurality of foot rail units connected to the lower end of the plurality of vertically extendable blinds, the plurality of vertically extendable blinds including:

a plurality of housings spaced side-by-side, each housing being pivotally connected to the head rail so that the housings can pivot about axes extending perpendicular to the head rail, a corresponding plurality of elongated flexible slats each having first and second ends and being coiled in different ones of the plurality of housings with the second end of each elongated flexible slat projecting through an opening in the associated housing enabling that slat to be extended from and retracted back into the associated housing, the second end of each elongated flexible slat being pivotally connected to the foot rail so that the lower end of each elongated flexible slat can pivot about an axis that is collinear to the pivotal connection of the associated housing to the head rail, whereby when the plurality of vertically extendable blinds are extended to position the foot rail a selected distance from the head rail, all of the plurality of vertically extendable slats may be turned between respective closed positions wherein all the plurality of vertically extendable slats are parallel to the head rail and foot rail and block the opening and respective open positions wherein all the plurality of vertically extendable slats are perpendicular to the head rail and foot rail and expose the opening, and a turning mechanism in the head rail which pivots all of the housings in unison to turn the plurality of vertically extendable slats between their respective open and closed positions, wherein the housing, the slat, and the foot rail unit have a similar width to that of the head rail unit, and the head rail unit and the shaft are attached to an adjacent head rail unit and an adjacent shaft, respectively.

21. The assembly defined in claim 20 and further including a brake mechanism on one or more of the housings to releasably set the extension of the blind.

* * * * *

UNITED STATES PATENT AND TRADEMARK OFFICE

CERTIFICATE OF CORRECTION

PATENT NO. : 8,851,142 B2
APPLICATION NO. : 13/575083
DATED : October 7, 2014
INVENTOR(S) : Jason T. Birkestrand It is certified that error appears in the above-identified patent and that said Letters Patent is hereby corrected as shown below:

In the Specification:

Column 1, line 8 should read:
PCT Patent Application No. PCT/US11/00588, which was Column 4, line 41 should read:
Also, if desired, the edges of the housing slot 80*b* may be In the Claims:

Claim 5, column 9, line 21 should read:
extended position and retracted position.

Claim 12, column 9, line 46 should read:
mechanism is a wind up spring type associated with a Claim 13, column 10, line 12 should read:
module to form a single head rail;

Signed and Sealed this
Third Day of February, 2015

Michelle K. Lee

Michelle K. Lee
*Deputy Director of the United States Patent and Trademark Office*